US007976401B2

(12) United States Patent
Sato et al.

(10) Patent No.: US 7,976,401 B2
(45) Date of Patent: Jul. 12, 2011

(54) GOLF CLUB AND SHAFT REPLACING METHOD

(75) Inventors: Fumiaki Sato, Saitama (JP); Hiroshi Takahashi, Saitama (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 193 days.

(21) Appl. No.: 12/266,405

(22) Filed: Nov. 6, 2008

(65) Prior Publication Data

US 2009/0258723 A1 Oct. 15, 2009

(30) Foreign Application Priority Data

Apr. 14, 2008 (JP) ..... P2008-104817

(51) Int. Cl.
*A63B 53/02* (2006.01)

(52) U.S. Cl. ..... 473/288; 473/307; 473/309; 473/310

(58) Field of Classification Search ..... 473/307, 473/288, 296, 298–299, 309
See application file for complete search history.

(56) References Cited

U.S. PATENT DOCUMENTS

| | | | | |
|---|---|---|---|---|
| 2,219,670 | A | 10/1940 | Wettlaufer | |
| 3,524,646 | A | 8/1970 | Wheeler | |
| 3,891,212 | A | 6/1975 | Hill | |
| 5,851,155 | A | 12/1998 | Wood et al. | |
| 5,906,549 | A | 5/1999 | Kubica | |
| 5,951,411 | A | 9/1999 | Wood et al. | 473/307 |
| 6,890,269 | B2 | 5/2005 | Burrows | |
| 7,083,529 | B2 | 8/2006 | Cackett et al. | 473/309 |
| 7,335,113 | B2 | 2/2008 | Hocknell et al. | 473/307 |
| 7,704,158 | B2 | 4/2010 | Burrows | 473/288 |
| 7,819,754 | B2 * | 10/2010 | Evans et al. | 473/307 |
| 2002/0037773 | A1 | 3/2002 | Wood et al. | |
| 2003/0228929 | A1 | 12/2003 | Miyasu et al. | 473/300 |
| 2004/0018887 | A1 | 1/2004 | Burrows | 473/307 |
| 2009/0181791 | A1 * | 7/2009 | Sanchez et al. | 473/307 |

FOREIGN PATENT DOCUMENTS

| | | | |
|---|---|---|---|
| FR | 2626187 | A1 | 7/1989 |
| FR | 2654354 | A1 | 5/1991 |
| GB | 2207358 | A | 2/1989 |
| JP | 64-39766 | U | 3/1989 |
| JP | 01-091875 | A | 4/1989 |
| JP | 02-049673 | A | 2/1990 |
| JP | 03-176084 | A | 7/1991 |
| JP | 04-156869 | A | 5/1992 |
| JP | 04-286787 | A | 10/1992 |
| JP | 07-231960 | A | 9/1995 |
| JP | 08-336622 | A | 12/1996 |
| JP | 09-075482 | A | 3/1997 |
| JP | 09-164227 | A | 6/1997 |
| JP | 10-151228 | A | 6/1998 |
| JP | 11-178954 | A | 7/1999 |
| JP | 2000-157650 | A | 6/2000 |
| JP | 2003-070940 | A | 3/2003 |
| JP | 2003-093551 | A | 4/2003 |

* cited by examiner

*Primary Examiner* — Stephen L. Blau
(74) *Attorney, Agent, or Firm* — Sughrue Mion, PLLC

(57) ABSTRACT

According to an aspect of the invention, a golf club includes: a golf club head having a hosel; a shaft; a shaft case fixed to one end of the shaft, and inserted into the hosel, the shaft case being formed in a substantially cylindrical shape; and a ring-shaped screw member screwed into one end of the hosel to fix the shaft case in the hosel, the ring-shaped screw member being detachable from the hosel.

11 Claims, 17 Drawing Sheets

GOLF CLUB AND SHAFT REPLACING METHOD

CROSS-REFERENCE TO RELATED APPLICATIONS

This application is based upon and claims the benefit of priority from Japanese Patent Application No. 2008-104817, filed Apr. 14, 2008, the entire contents of which are incorporated herein by reference.

BACKGROUND

1. Field

The present invention relates to a golf club and, specifically, it relates to a golf club which is capable of replacing a shaft easily. Also, the invention relates to a method for replacing the shaft of the golf club.

2. Description of the Related Art

A golf club includes a shaft and a head mounted on the leading end portion of the shaft. A grip is mounted on the base end portion of the shaft.

In a conventional ordinary golf club head, a hosel hole is formed directly in the head, and a shaft is inserted into the hosel hole and is fixed to the golf club head using an adhesive. Here, as the adhesive, there is generally used an epoxy-system adhesive. For replacement of the shaft, the hosel hole portion of the golf club head may be heated to destroy the structure of the hosel hole portion made of hardened epoxy resin, whereby the shaft can be pulled out.

In the Japanese Patent Publication Hei-11-178954, there is disclosed a golf club head structured such that a head main body and a hosel are provided separately from each other and the hosel is fixed to the head main body using a screw. According to the structure of the golf club head disclosed in the Japanese Patent Publication Hei-11-178954, a plate-shaped neck portion is formed on the lower end side of the hosel and the neck portion is inserted into the insertion portion of the head main body and is then fixed to the head main body using a screw. By fixing the plate-shaped neck portion to the head main body in this manner, when hitting a golf ball with the golf club, that is, at the impact time, the neck portion is caused to bend to thereby relieve the concentration of stresses that are generated in the connecting portion between the shaft and hosel.

In the golf club head disclosed in the above-cited Japanese Patent Publication Hei-11-178954, the connecting strength and rigidity of the head main body and hosel are short, thereby being unable to provide a strong feeling of impact. Also, the position of the hosel is excessively high.

SUMMARY OF THE INVENTION

According to an aspect of the present invention, there is provided a golf club including: a golf club head having a hosel; a shaft; a shaft case fixed to one end of the shaft, and inserted into the hosel, the shaft case being formed in a substantially cylindrical shape; and a ring-shaped screw member screwed into one end of the hosel to fix the shaft case in the hosel, the ring-shaped screw member being detachable from the hosel.

DETAILED DESCRIPTION

Figure 1:
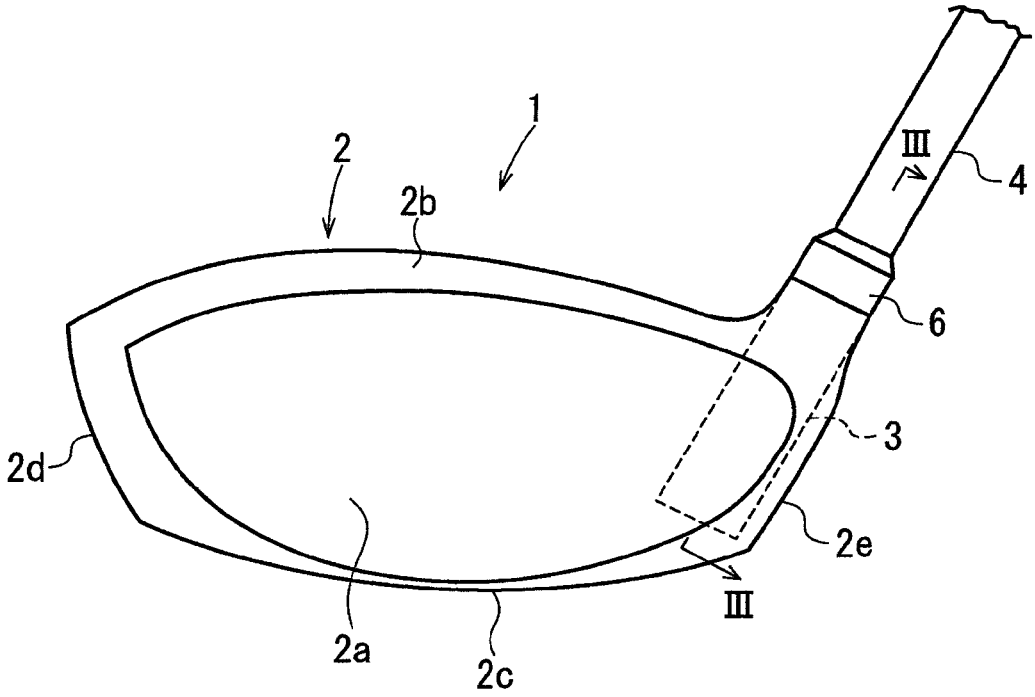
FIG. 1 is a front view of a head according to a first embodiment of the invention.
Figure 2:
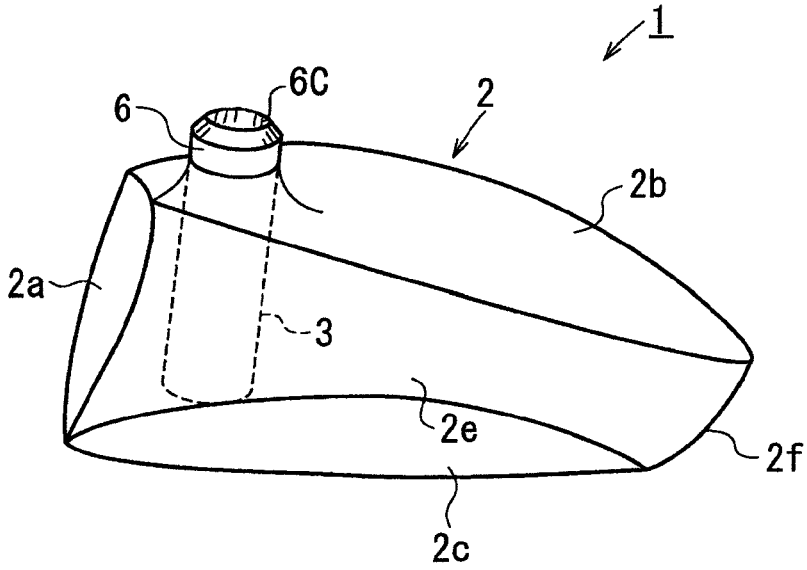
FIG. 2 is a side view of the heel side of the head.
Figure 3:
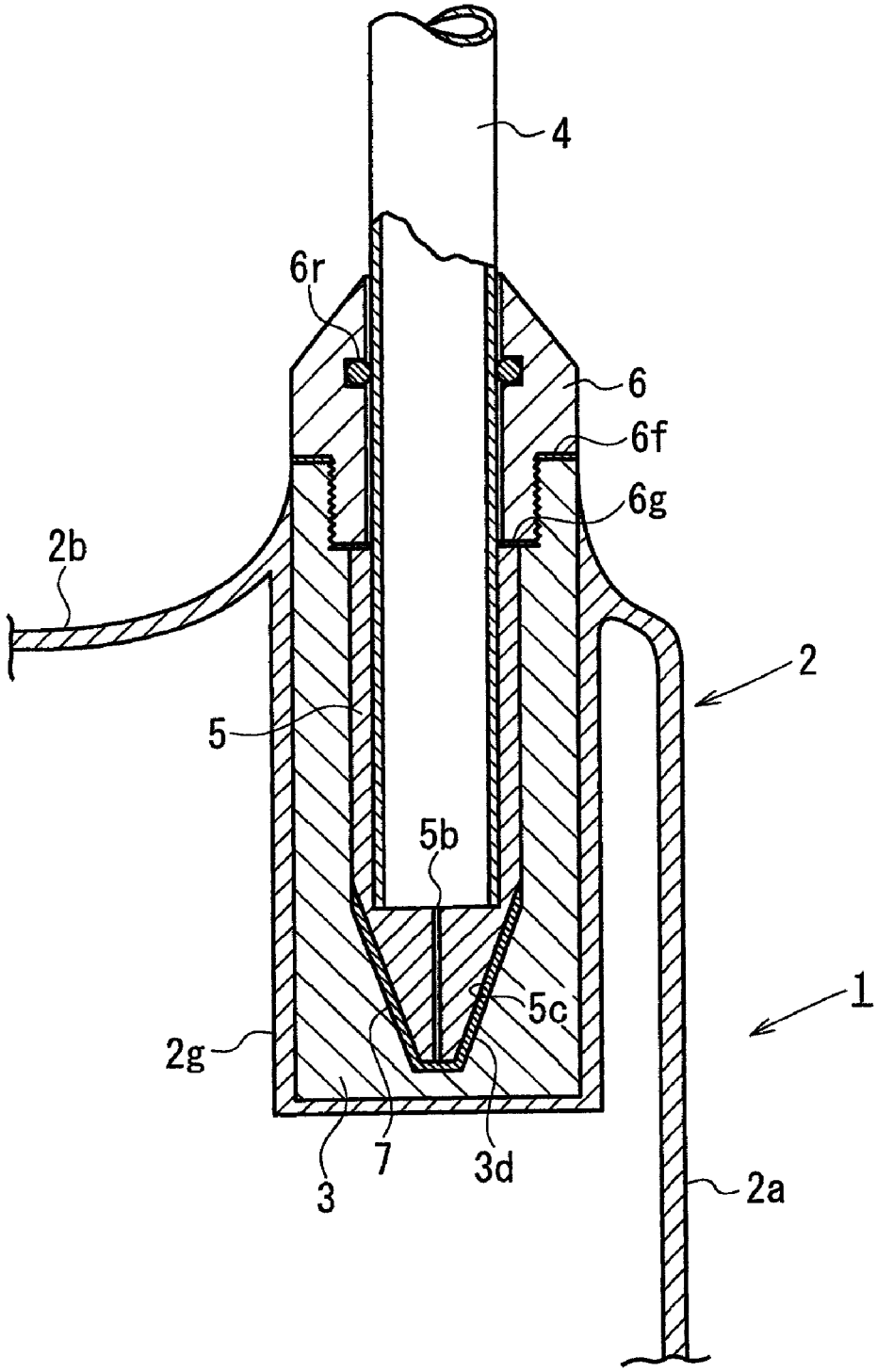
FIG. 3 is a section view taken along the III-III line shown in FIG. 2.
Figure 4:
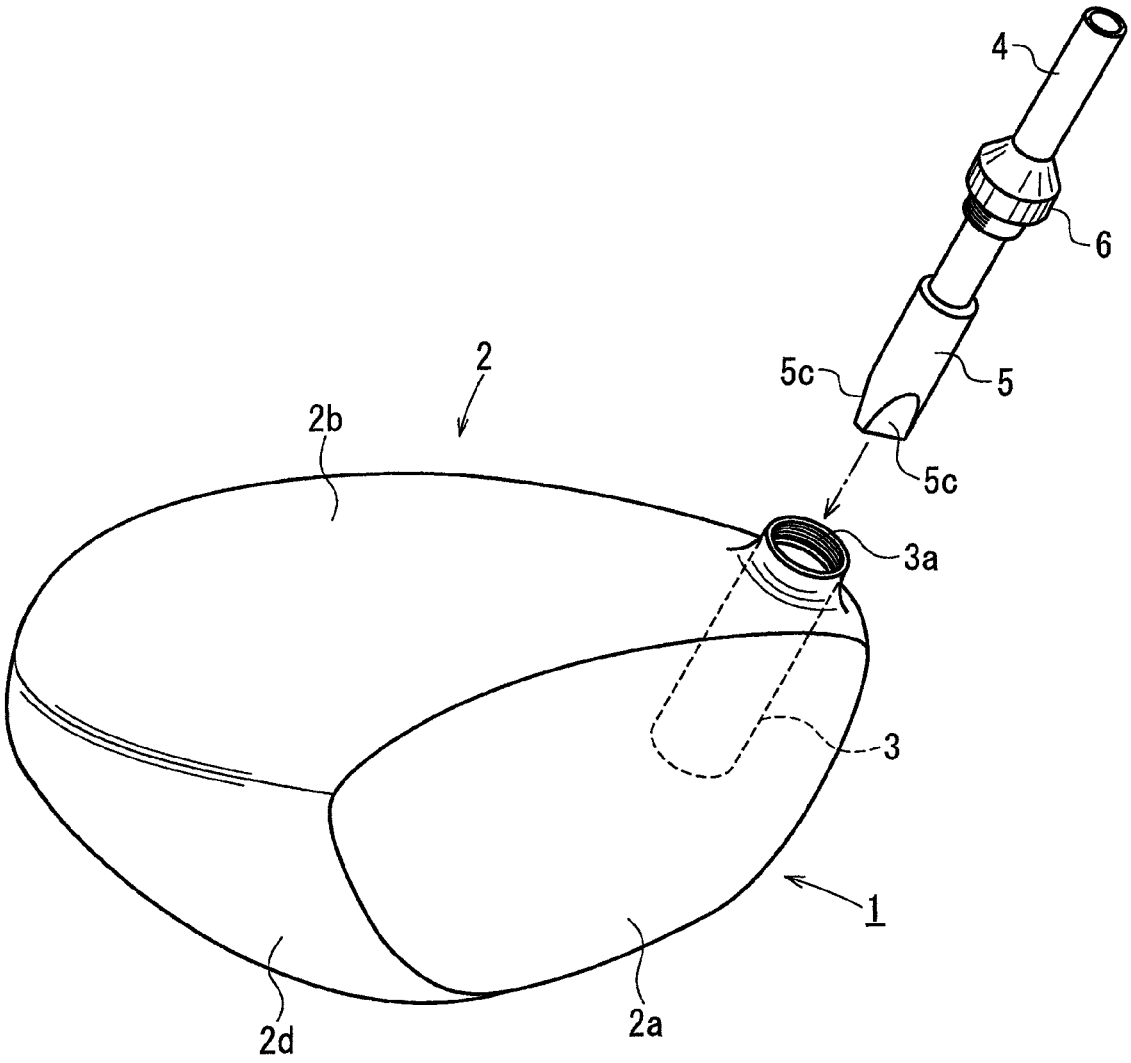
FIG. 4 is a perspective view to show how to mount and replace a shaft.
Figure 5A:
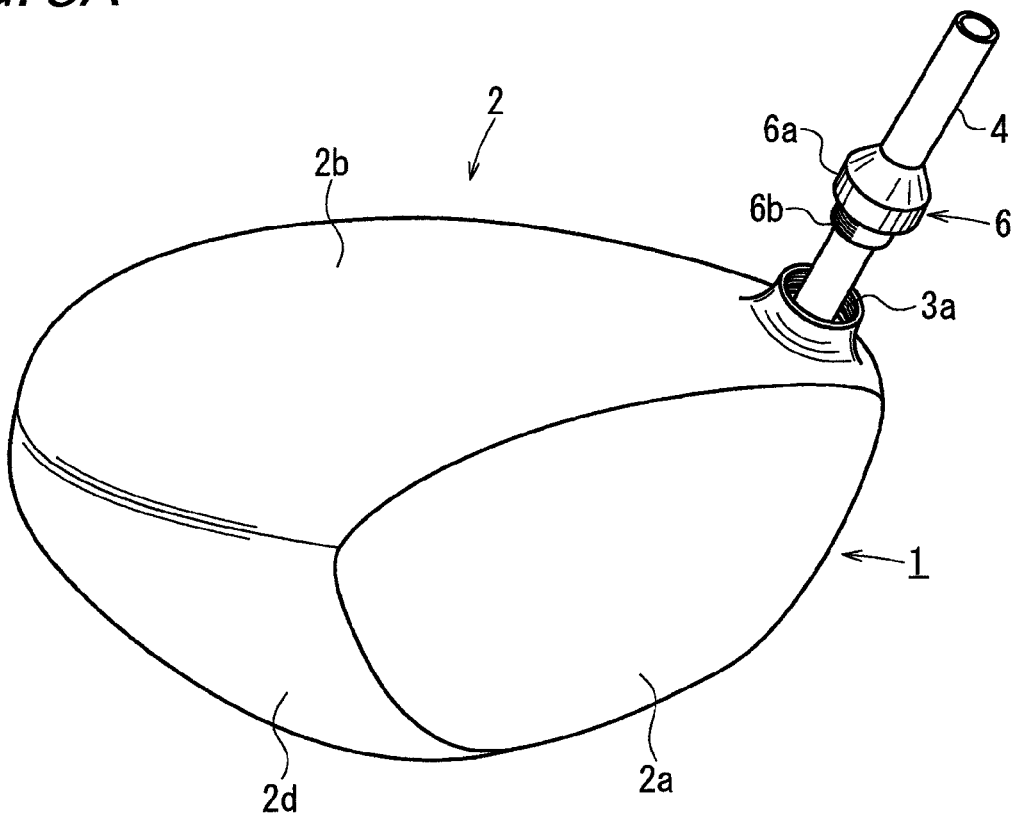
FIGS. 5A and 5B are perspective views to show how to mount and replace a shaft.
Figure 5B:
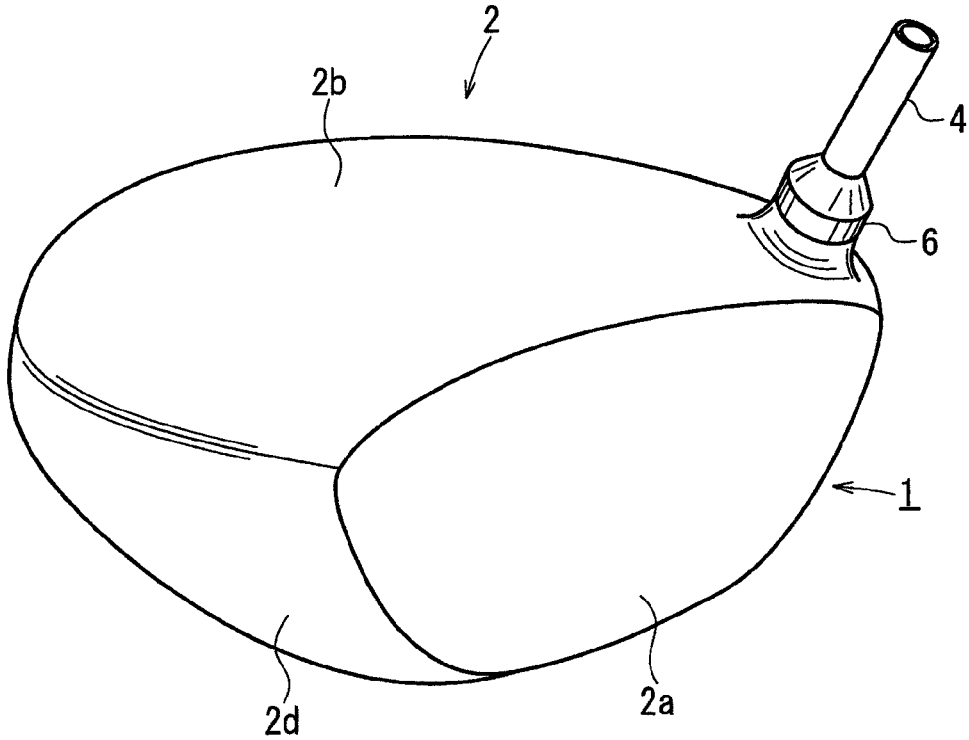
Figure 6:
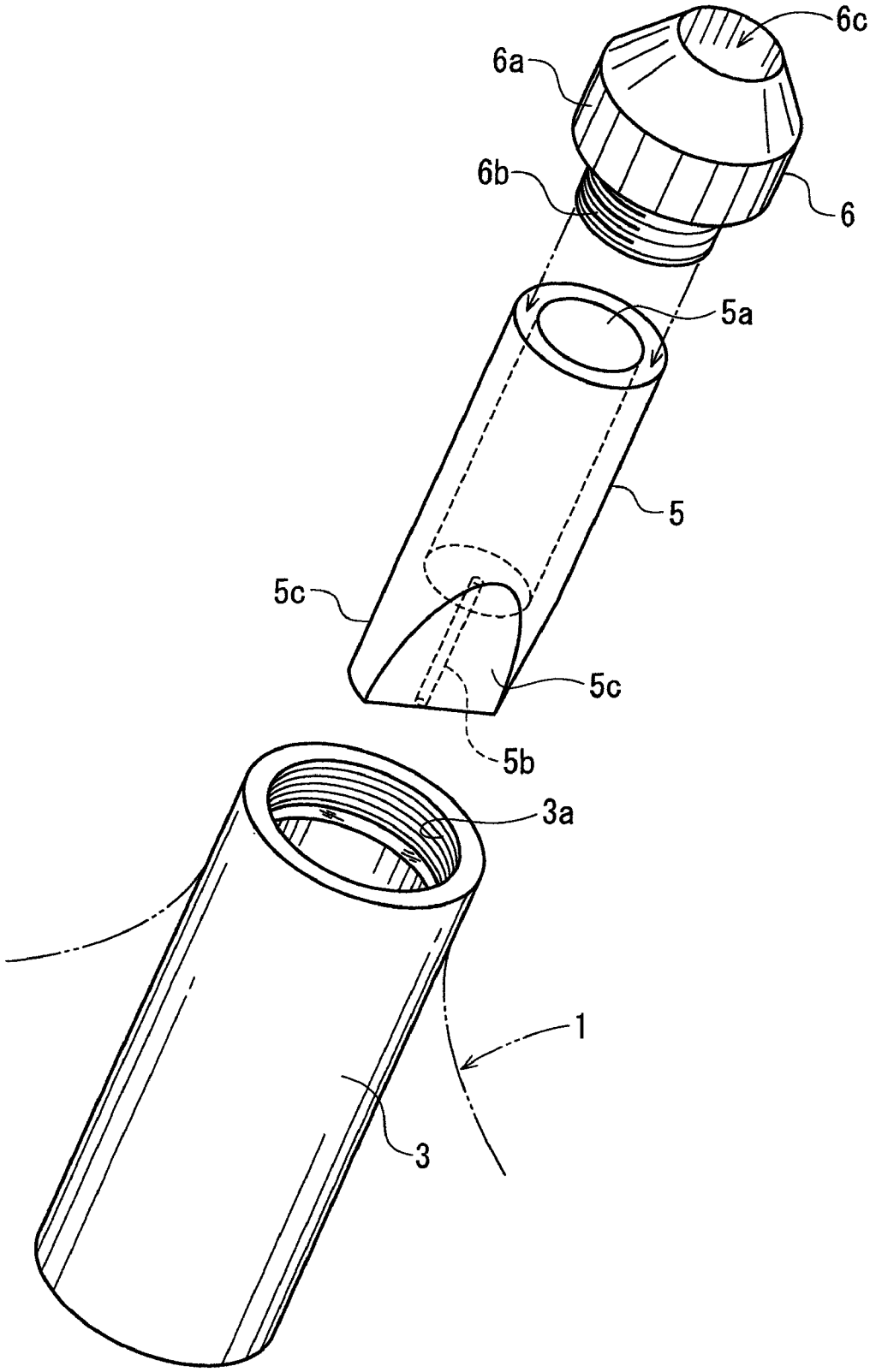
FIG. 6 is a perspective view of a hosel, a shaft case and a screw member.
Figure 7:
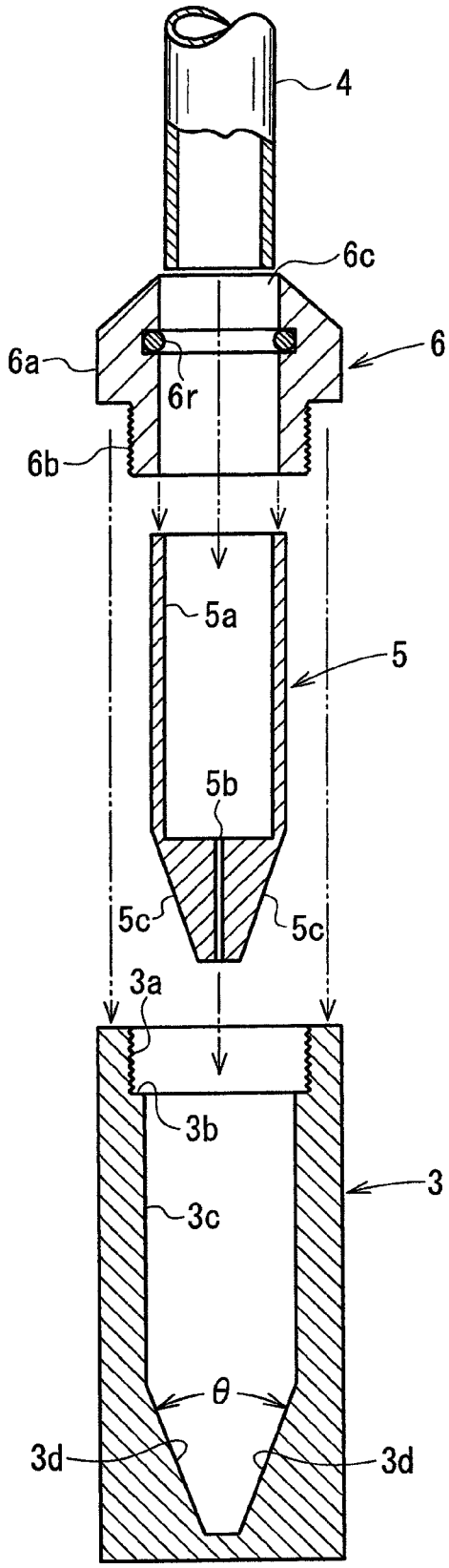
FIG. 7 is a section view of a hosel, a shaft case and a screw member.
Figure 8:
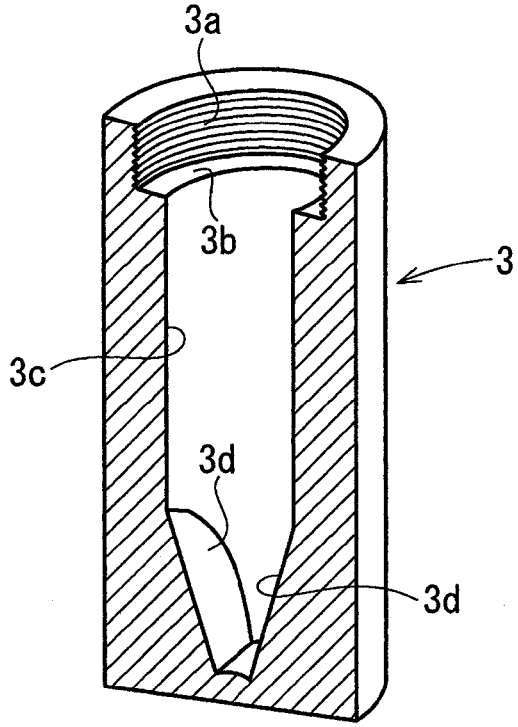
FIG. 8 is a sectional perspective view of the hosel.

Now, description will be given below of embodiments according to the invention with reference to the accompanying drawings. FIG. 1 is a front view of a golf club head according to an embodiment of the invention. FIG. 2 is a side view of the heel side of the golf club head. FIG. 3 is a section view taken along the III-III line shown in FIG. 1. FIGS. 4 and 5(A), 5B are respectively perspective views of the golf club head, showing how to mount and replace the shaft of the golf club head. FIG. 6 is a perspective of a shaft case and a screw member. FIG. 7 is a section view of a hosel, shaft case and screw member. FIG. 8 is a sectional perspective view of the hosel.

In this golf club, a shaft 4 is mounted on the hosel 3 of a head 1 through a shaft case 5 and a screw member 6.

The head 1 includes a head main body 2 and a hosel 3 mounted on the head main body 2. This head 1, which is of a hollow wood type, includes a face portion 2*a*, a crown portion 2*b*, a sole portion 2*c*, a toe portion 2*d*, a heel portion 2*e* and a back portion 2*f*.

As shown in FIG. 3, in the face portion 2*a* side and heel portion 2*e* side of the crown portion 2*b*, there is formed a cylindrical-shaped hosel installation portion 2*g*. The hosel installation portion 2*g* has a cylindrical shape the upper end of which is open and the lower end of which is closed, and also the hosel installation portion 2*g* extends coaxially with the shaft 4. The hosel 3 is inserted into the hosel installation portion 2*g* from above and is fixed by proper fixing means such as by welding, by brazing, by adhesion, by shrinkage fit, or by expansion fit.

As shown in FIGS. 6~8, the hosel 3 has a substantially cylindrical shape in which there is opened up a hole extending in the axial direction thereof from the upper end thereof toward the lower end thereof.

In the hole entrance side, that is, in the inner peripheral surface of the upper end side of the hosel, there is formed a female screw 3*a*. Continuously with the female screw 3*a*, specifically, in the diameter-reducing direction of the hosel 3, there is formed a step surface 3*b*; and, the deeper side of the hosel 3 than the step surface 3*b* is formed as a cylindrical portion 3*c*. In the deeper side of the hosel 3 than the cylindrical portion 3*c*, there are formed a pair of inclined surfaces 3*d* and 3*d* which respectively intersect obliquely with the axis of the hosel 3. The inclined surfaces 3*d*, 3*d* are arranged symmetrically with the axis of the hosel 3 between them. The distance between the two inclined surfaces 3*d*, 3*d*, that is, the spacing thereof in the direction perpendicular to the hosel axial line decreases as it goes toward the lower end side of the hosel 3. The angle of intersection θ (FIG. 7) between the inclined surfaces 3*d*, 3*d*, preferably, may be set for 10~30°, more preferably, for 15~20°.

As shown in FIGS. 6 and 7, the shaft case 5 is a cylindrical member having a diameter slightly smaller than the diameter of the cylindrical portion 3*c* of the hosel 3; and the shaft case 5 has a hole 5*a* which extends from the upper end side thereof toward the lower end side thereof and into which the shaft 4 can be inserted. The length of the cylindrical portion of this hole 5*a* preferably may be 10 mm or more, for example, 10~50 mm, more preferably, about in the range of 20~40 mm. In the shaft case 5, there is opened up a small hole 5*b* serving as an air bleeder which extends from the deep bottom surface of the hole 5*a* to the lower end face of the shaft case 5. Here, the cylindrical portion of the hole 5*a* of the shaft case 5, preferably, may extend up to (deeper than) a position where the inclined surfaces 3*d* are formed. In the present golf club, when hitting the ball, the inclined surfaces receive the hitting impact. Therefore, the present golf club can provide a similar hitting feeling to a golf club in which a head and a shaft are fixed together using an ordinary adhesive.

On the outer surface of the lower end side of the shaft case 5, there are provided a pair of inclined surfaces 5*c* and 5*c*. These inclined surfaces 5*c* and 5*c* are arranged symmetrically with the axial line of the shaft case 5 between them. The distance between the inclined surfaces 5*c* and 5*c*, that is, the spacing thereof in the direction perpendicular to the axial line of the shaft case 5 decreases as it goes toward the lower end side of the shaft case 5. The angle of intersection θ between the inclined surfaces 5*c* and 5*c* is the same as the angle of intersection θ between the inclined surfaces 3*d* and 3*d* of the hosel 3. The size of the inclined surface 5*c* of the shaft case 5 may be the same as the inclined surface 3*d* of the hosel 3, or, when an elastic member is interposed between the inclined surfaces 5*c*, the size of the inclined surface 5*c* may be slightly smaller than that of the inclined surface 3*d*.

Although not shown, the inner peripheral edge of the upper end side of the shaft case 5 may be chamfered about at an angle of 20~45° to thereby facilitate the insertion of the shaft 4. Also, the outside diameter of the upper end side of the shaft case 5 may be increased, whereby the upper end side of the shaft case 5 may be formed in a flange shape. In this case, as will be discussed later, it is possible to increase the pressing area of the lower end face of the screw member 6 when the screw member 6 lower end face presses the upper end face of the shaft case 5.

The screw member 6 has a substantially ring-like shape. The lower half section of the screw member 6 is formed smaller in diameter than the upper half section 6*a* thereof and, on the outer peripheral surface of the lower section of the screw member 6, there is cut formed a male screw 6*b*. The upper end side of the upper half section 6*a* is formed in a tapered shape (in a truncated conical shape). The lower half section of the screw member 6 is formed to have a diameter which allows the male screw 6*b* to be threadedly engaged with the female screw 3*a* of the hosel 3. The screw member 6 has a hole 6*c* which penetrates through the screw member 6 in the axial direction thereof and into which the shaft 4 can be inserted.

Here, the diameter of the hole 6*c* is set slightly larger than the diameter of the shaft 4. On the inner peripheral surface of the hole 6*c*, there is mounted an O ring 6*r* made of an elastomer or the like, and the circumference of the O ring 6*r* is contacted with the shaft 4, thereby enhancing the sliding performance between the shaft 4 and the inner peripheral surface of the hole 6*c* and also preventing the rickety motion of the shaft 4. Also, between the screw member 6 and the end faces of the hosel 3 and shaft case 5, there are interposed thin spacers 6*f* and 6*g* which are respectively elastic members made of rubber, or an elastomer, or other similar material.

To assemble this golf club, as shown in FIG. 4, the screw member 6 may be inserted through the shaft 4 from the leading end side thereof and the shaft case 5 may be fixed to the leading end of the shaft 4 using an adhesive previously. Preferably, the adhesive may be applied to the outer peripheral surface of the leading end portion of the shaft 4 and the shaft 4 may be inserted into the deepest portion of the hole 5*a* of the shaft case 5.

Since the small hole 5*b* is formed in the shaft case 5, when the shaft 4 is inserted into the hole 5*a* of the shaft case 5, the air flows out through the small hole 5*b*. As the adhesive, preferably, there may be used an epoxy-system adhesive or the like.

In this manner, the screw member 6 is inserted and, at the same time, the shaft case 5 of a shaft case/shaft connected assembly is inserted into the hosel 3 of the head 1 in such a manner as shown in FIG. 4. Here, according to the present embodiment, on the inclined surfaces 5*c*, 5*c* of the shaft case 5 and the leading end face of the shaft case 5, there has been provided an elastic member 7 which is made of rubber, an elastomer or similar material and is formed in a thin-piece-like shape having a small thickness (for example, a thickness of about 0.5~5 mm) by facing or by bonding. The elastic member 7 may also have been provided on the shaft case 5 previously, or it may also be provided on the shaft case 5 after the shaft case/shaft connected assembly is formed.

As shown in FIG. 4, the shaft case 5 is inserted into the hosel 3, whereby the inclined surfaces 5*c*, 5*c* are superimposed on top of the inclined surfaces 3*d*, 3*d* respectively. Next, as shown in FIG. 5A, the male screw 6*b* of the screw member 6 is screwed into the female screw 3*a* of the hosel 3.

As a result of this, as shown in FIG. 3, the lower end face of the screw member 6 is contacted with the upper end face of the shaft case 5, and the inclined surfaces 5*c* of the shaft case 5 are respectively pressed against the inclined surfaces 3*d* of the hosel 3, whereby the shaft case 5 is fixed to the hosel 3. The shaft case 5 and shaft 4 are now firmly bonded to each other by the adhesive, which completes a golf club in which the shaft 4 and head 1 are formed as an integral body. In this golf club, since the shaft case 5 with the shaft 4 bonded thereto is inserted into the hosel 3 and is then fixed using the screw member 6, the mounting strength and rigidity of the shaft 4 and shaft case 5 are excellent.

Here, as shown in FIG. 3, since the thin-piece-shaped elastic member 7 made of rubber, elastomer, synthetic resin or the like is interposed between the inclined surfaces 3*d* of the hosel 3 and the inclined surfaces 5*c* of the shaft case 5, shocks and vibrations possibly generated at the impact time can be absorbed.

To replace the shaft of a golf club, a shaft case of the same type as the above-mentioned shaft case 5 may have been previously fixed to a new shaft to be substituted using an adhesive. Here, the screw member 6 may also have been mounted on this shaft.

Then, the screw member 6 of an old or currently used golf club is removed, and the old or currently used shaft 4 of this golf club is removed from the head 1 of this golf club together with the old or currently used shaft case 5 and screw member 6. Next, the new shaft (shaft case/shaft connected assembly) with a shaft case and a screw member connected thereto is inserted into the head 1 and is then fixed to the head 1 using the screw member 6.

In this manner, the mounting and replacement of the shaft can be carried out very simply and quickly. Here, conventionally, to replace a shaft, the hosel portion of an old or currently used golf club is heated to destroy the structure of a hardened adhesive, and the shaft is then removed from the golf club; and, after then, a new shaft is fixed to the golf club using an adhesive. Accordingly, it takes several hours to about one day to complete the operation to replace the old shaft with the new shaft. However, according to the above-mentioned embodiment of the invention, by having mounted a shaft case 5 on a new shaft previously, the shaft replacement operation can be completed several minutes or so. Therefore, it is possible to realize a using system in which shafts each with a shaft case adapted for various speculations have been previously prepared and different shafts are mounted sequentially on the same head main body for testing the hitting feelings of the respective shafts.

Here, according to the present embodiment, there are provided the inclined surfaces 3*d* and 5*c*, the inner surface of the hole deep side of the hosel 3 and the outer surface of the lower end side of the shaft case 5 are respectively formed in a non-circular section shape (that is, the section of the shape perpendicular to the axial line thereof is non-circular in shape), and the inclined surfaces 3*d* and 5*c* are engaged with each other. This can reduce the rickety motion of the shaft 4 and also can prevent the shaft 4 from rotating around the axial line thereof. That is, the torque direction fixture rigidity of the shaft 4 is high.

Also, since there are provided a pair of inclined surfaces 5*c* and 5*c* and thus the leading end side of the shaft case 5 is formed in a tapered shape, the shaft case 5 can be easily inserted into the hosel 3.

Figure 9A:
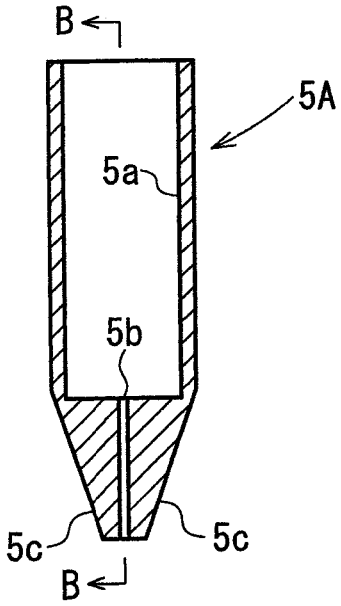
FIGS. 9A and 9B are section views of a shaft case according to a second embodiment.
Figure 9B:
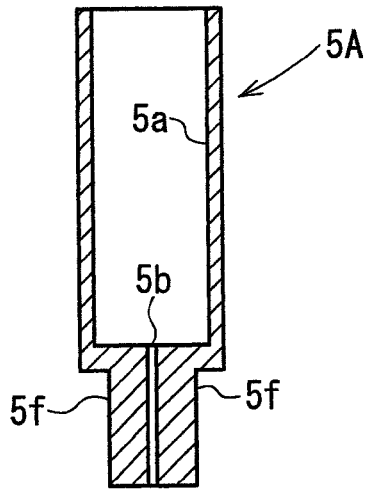

According to the invention, like a shaft case 5A shown in FIGS. 9A and 9B, there may also have been provided a pair of parallel surfaces 5*f* on the leading end side of the shaft case 5A. When these parallel surfaces 5*f* are gripped by a gripping tool, it is possible to facilitate the operation to mount and remove the shaft case 5A with respect to the shaft 4. The remaining structures of the shaft case 5A in FIGS. 9A and 9B are the same as the above-mentioned shaft case 5 and the same designations in FIGS. 9A and 9B express the same portions.

Although, in the above-mentioned embodiment, the screw member 6 includes the male screw 6*b* and the hosel 3 includes the female screw 3*a*, alternatively, the upper end of the hosel may also be projected from the head main body 2 and a male screw may be provided on the outer periphery of the hosel upper end. In this case, the screw member is formed in a cap shape and there is provided a female screw which can be threadedly engaged with the male screw.

The above-mentioned hosel, shaft case and screw member may preferably be made of metal and, specifically, they may preferably be made of aluminum, titanium or an alloy thereof. The hosel 3, which is formed separately from the head 1, may preferably be made of material having a specific gravity equal to or lower than the head main body, for example, a titanium alloy, aluminum, an aluminum alloy, a magnesium alloy, FRP, or synthetic resin.

Although the material of the head is not limited to a specific material, for a wood type of golf club head, there can be used, for example, a titanium alloy, an aluminum alloy or stainless steel.

Although there are provided a pair of inclined surfaces 5*c*, 5*c* and a pair of inclined surfaces 3*d*, 3*d* in the above-mentioned embodiment, alternatively, the number of inclined surfaces may be one, or three or more. However, as shown in the drawings, preferably, the shaft case 5 and hosel 3 may respectively have a pair of inclined surfaces.

Here, as a grip to be mounted onto the shaft 4, there is known a grip the section of which is non-circular. For example, there is known a grip having a shape in which such lower side surface of the outer peripheral surface of the grip as facing the ground when a golfer is addressing the ball is expanded more than the remaining surfaces of the grip outer peripheral surface. In this case, when mounting the shaft case 5 onto the shaft 4, the direction of the peripheral direction of the shaft case 5 may be determined so as to correspond to the above grip expansion portion. This makes it possible to mount the shaft onto the head such that the grip expansion portion can face the ground positively.

Figure 10:
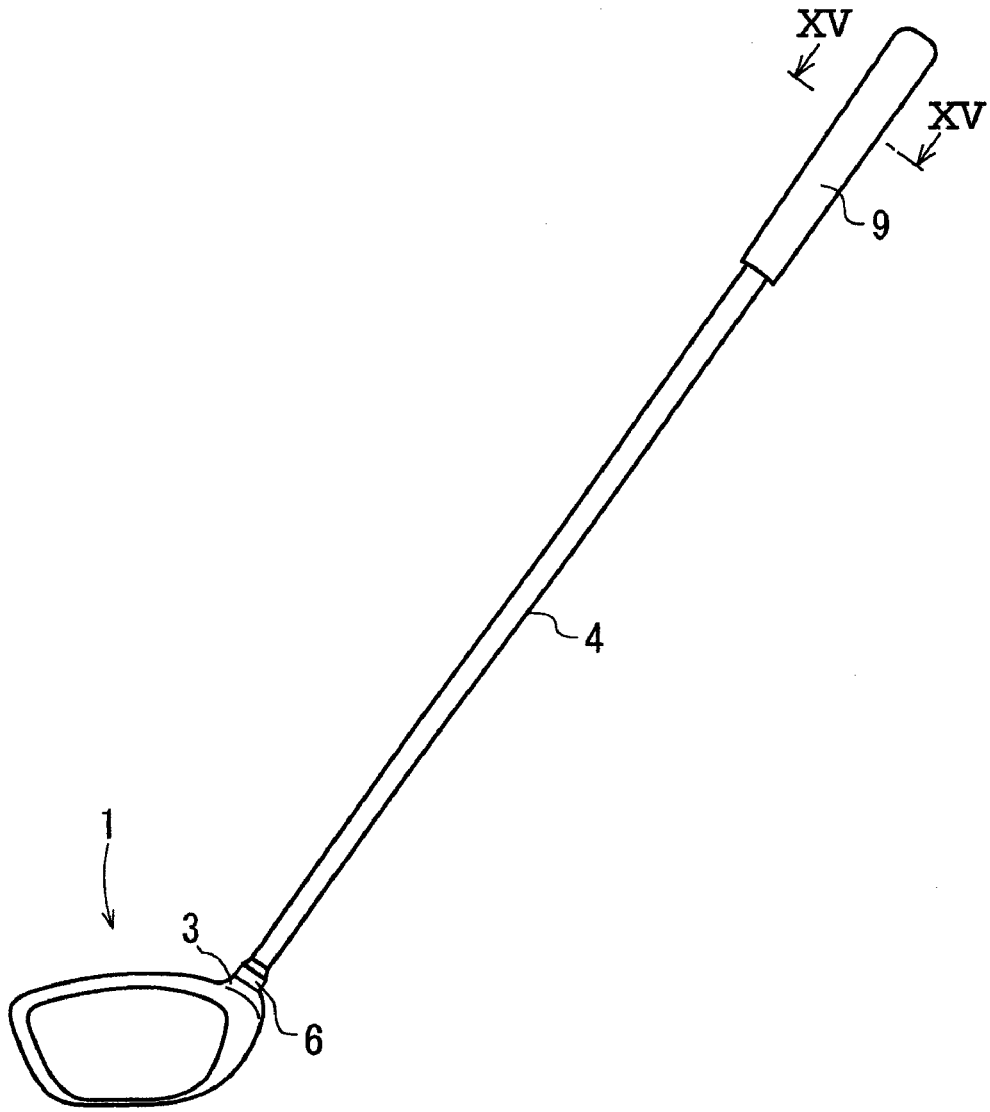
FIG. 10 is a front view of a golf club according to the first embodiment.

FIGS. 11~15 respectively show an example of the grip having such non-circular section, while FIG. 10 shows a golf club including a head 1 on which such grip is mounted.

Figure 11:
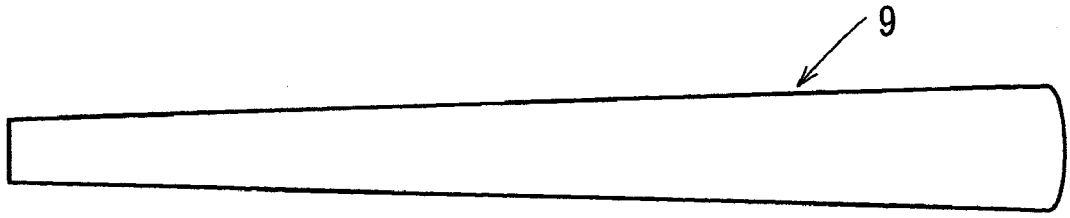
FIG. 11 is a side view of a grip.
Figure 12:
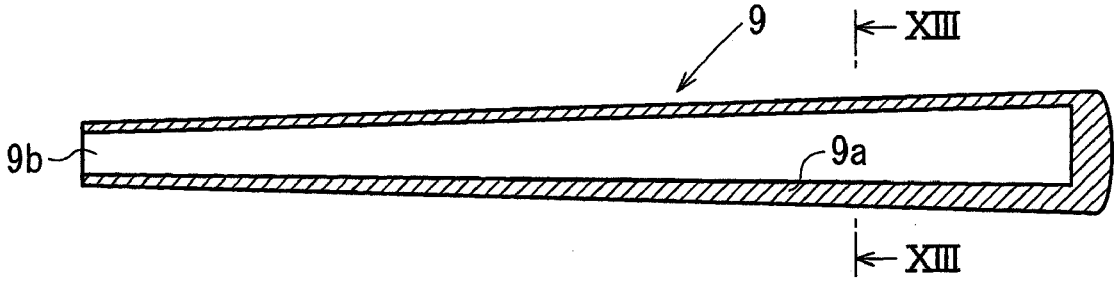
FIG. 12 is a section view of a grip.
Figure 13:
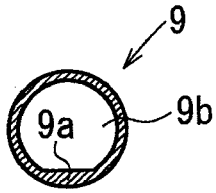
FIG. 13 is a section view taken along the XIII-XIII line shown in FIG. 12.
Figure 14:
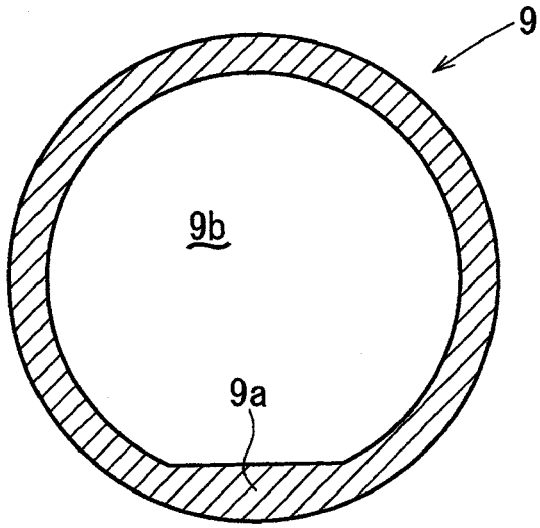
FIG. 14 is an enlarged view of FIG. 13.
Figure 15:
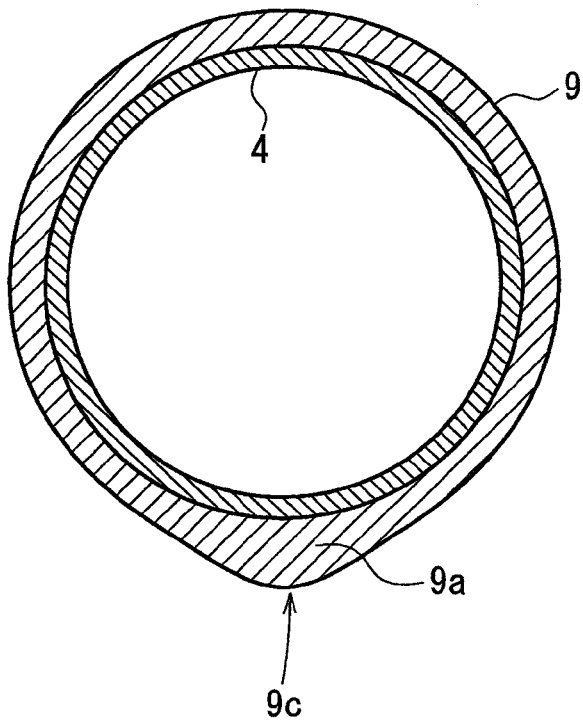
FIG. 15 is an enlarged section view taken along the XV-XV shown in FIG. 10.

Specifically, FIG. 11 is a side view of a grip 9, FIG. 12 is a longitudinal section view of the grip 9 in the longitudinal direction thereof, FIG. 13 is a section view taken along the XIII-XIII line shown in FIG. 12, FIG. 14 is an enlarged view of FIG. 13, and FIG. 15 is an enlarged section view taken along the XV-XV shown in FIG. 10, respectively.

As shown in FIG. 10, the leading end of a shaft 4 is inserted into the hosel of the head 1 and is fixed thereto using an adhesive. Here, preferably, when the upper end side of a screw member 6 is formed in a conical shape like a ferrule as shown in FIG. 10, there can be eliminated a strange feeling from the appearance of the golf club.

The grip 9 has a substantially cylindrical shape including an insertion hole 9*b* for insertion of the shaft 4 and is made of rubber or the like. The grip 9 includes a thick portion 9*a* in a portion thereof (the lower side portion in FIGS. 12, 13, 14 and 15) in its peripheral direction. This thick portion 9*a* extends in the longitudinal direction of the grip 9. And, the thick portion 9*a* is structured such that the section shape of the inner peripheral surface of the grip 9 (that is, the section shape in a direction perpendicular to the longitudinal direction of the grip 9) provides a chord shape. When the shaft 4 is inserted into the grip 9, as shown in FIG. 15, the thick portion 9*a* is pressed outwardly from the inside and the outer periphery thereof is expanded, thereby forming a projecting portion 9*c*. This projecting portion 9*c* extends in the longitudinal direction of the grip 9 (that is, the longitudinal direction of the shaft 4). The shaft cases 5, 5A are mounted on the shaft 4 in such a manner that the projecting portion 9*c* can be positioned so as to face downward, that is, to face the ground when the golfer is addressing a ball, thereby forming shaft case/shaft connected assemblies. In this case, when any one of the shaft case/shaft connected assemblies is mounted onto the head 1, the projecting portion 9*c* can always be positioned on the ground side correctly in the addressing position of the golfer.

Although the golf club head is of a wood type in the above-mentioned embodiment, the invention can also be applied to any one of golf club heads of a utility type, an iron type, a putter type or other types.

Here, in the case of a golf club head of a hollow type, since there are provided the hosel 3 and hosel installation portion 2*g* as well as the shaft case 5 and screw member 6, the heel side weight of the golf club head is heavier than an ordinary golf club head. In view of this, preferably, by increasing the thickness of the toe side or back portion thereof, or by providing a weight on the toe side thereof, the golf club head may be balanced well.

Figure 16:
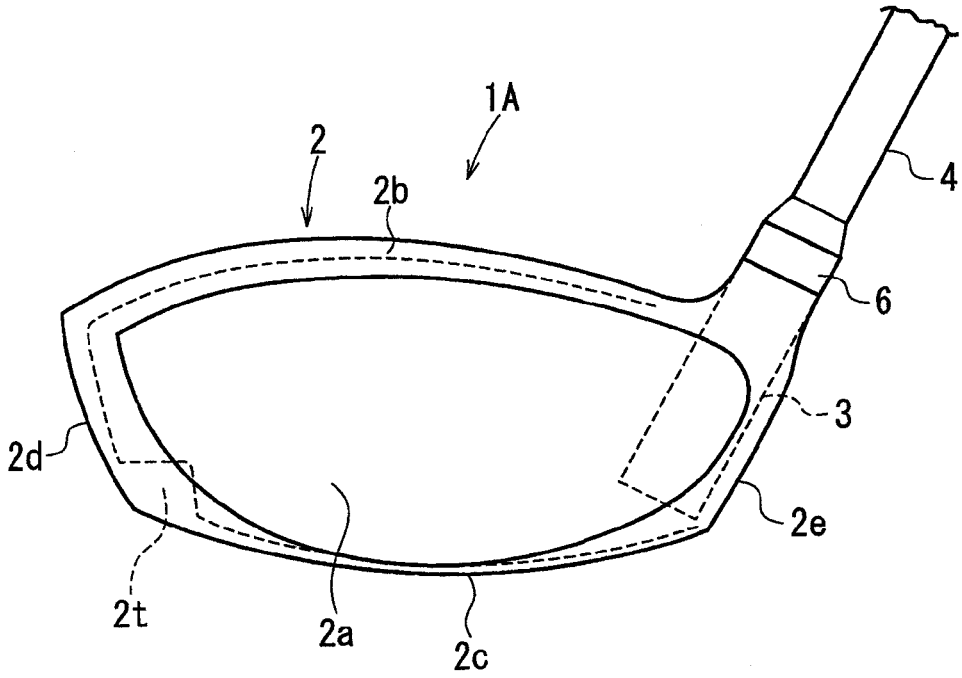
FIG. 16 is a front view of a head according to a third embodiment of the invention.
Figure 17:
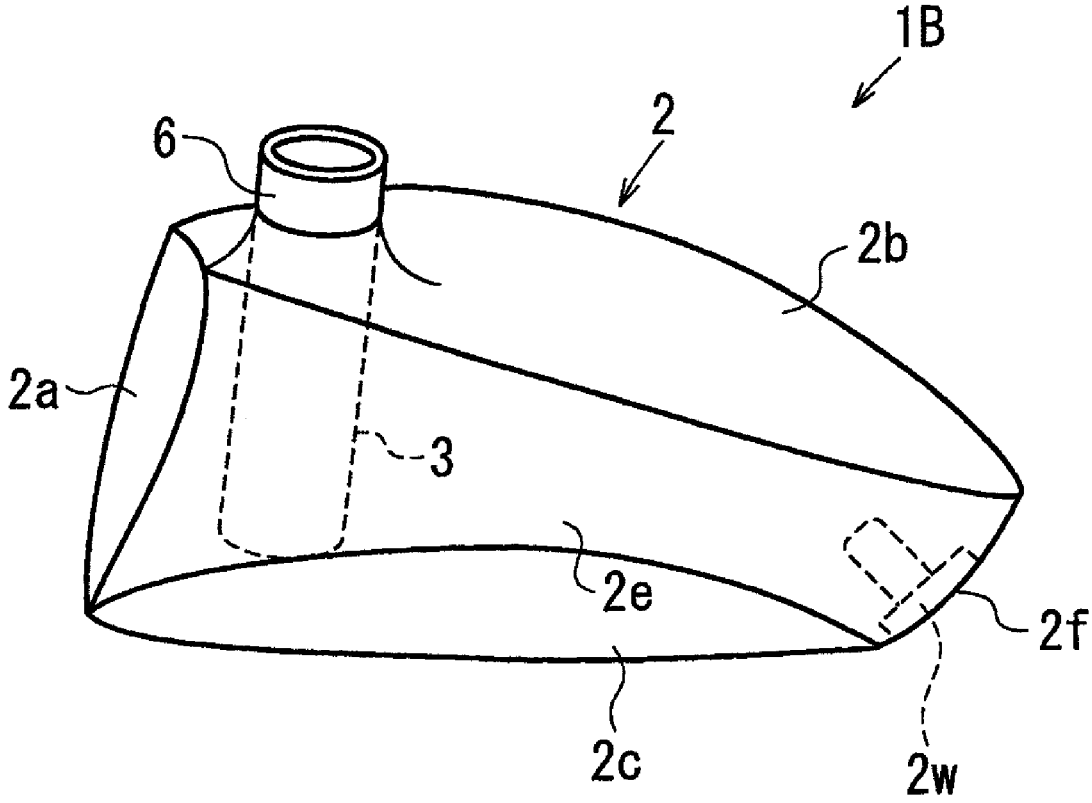
FIG. 17 is a side view of a head according to a fourth embodiment of the invention.

FIGS. 16 and 17 respectively show examples of such golf club head. Specifically, FIG. 16 is a front view of a golf club head 1A in which a thickness portion 2*t* is formed on the toe portion 2*d* side of a head main body 2, and FIG. 17 is a side view of a golf club head 1B in which a weight screw 2*w* is mounted on the back portion 2*f* of a head main body 2. Here, a female screw hole for weight adjustment may be formed in the sole portion of the golf club head, in the toe-side side portion thereof, or in back portion thereof, and also a plurality of screws differing in weight may be prepared. In this case, by replacing a currently used screw with a new one different in weight, the swing balance of the golf club can be adjusted, or the position of center of gravity of the golf club head can be adjusted.

Preferably, as shown in FIG. 16, the toe side of the golf club head may be thick, or a weight member having a larger specific gravity than the head main body may be disposed on the toe side of the golf club head. The reason for this is that, structurally, when compared with an ordinary golf club head, the heel side thereof tends to be heavy.

The remaining structures of FIGS. 16 and 17 are similar to FIGS. 1 and 2, and the same designations thereof express the same composing elements shown in FIGS. 1 and 2.

Figure 18:
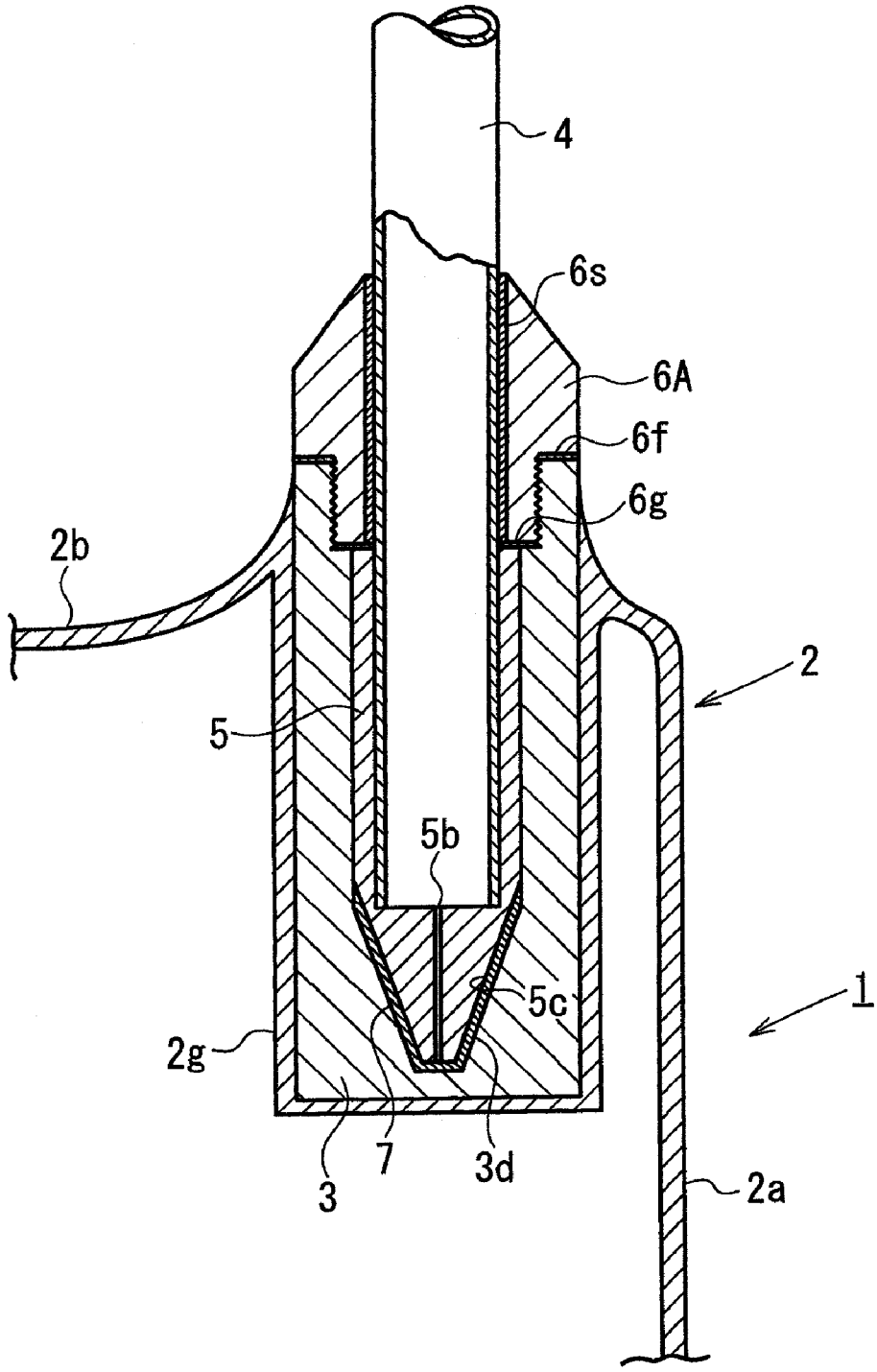
FIG. 18 is a section view of a head according to a fifth embodiment of the invention.

According to the invention, as shown in FIG. 18, between the inner peripheral surface of a screw member 6A and a shaft 4, there may also be interposed a thin cylindrical sleeve 6*s* which is an elastic member made of rubber, elastomer or the like. The inner peripheral surface of the sleeve 6*s* is in contact with the shaft 4, while the outer peripheral surface thereof is in contact with the inner peripheral surface of a screw member 6A. The remaining structures of FIG. 18 are the same as FIG. 3, and the same designations thereof show the same composing elements of FIG. 3.

Figure 19:
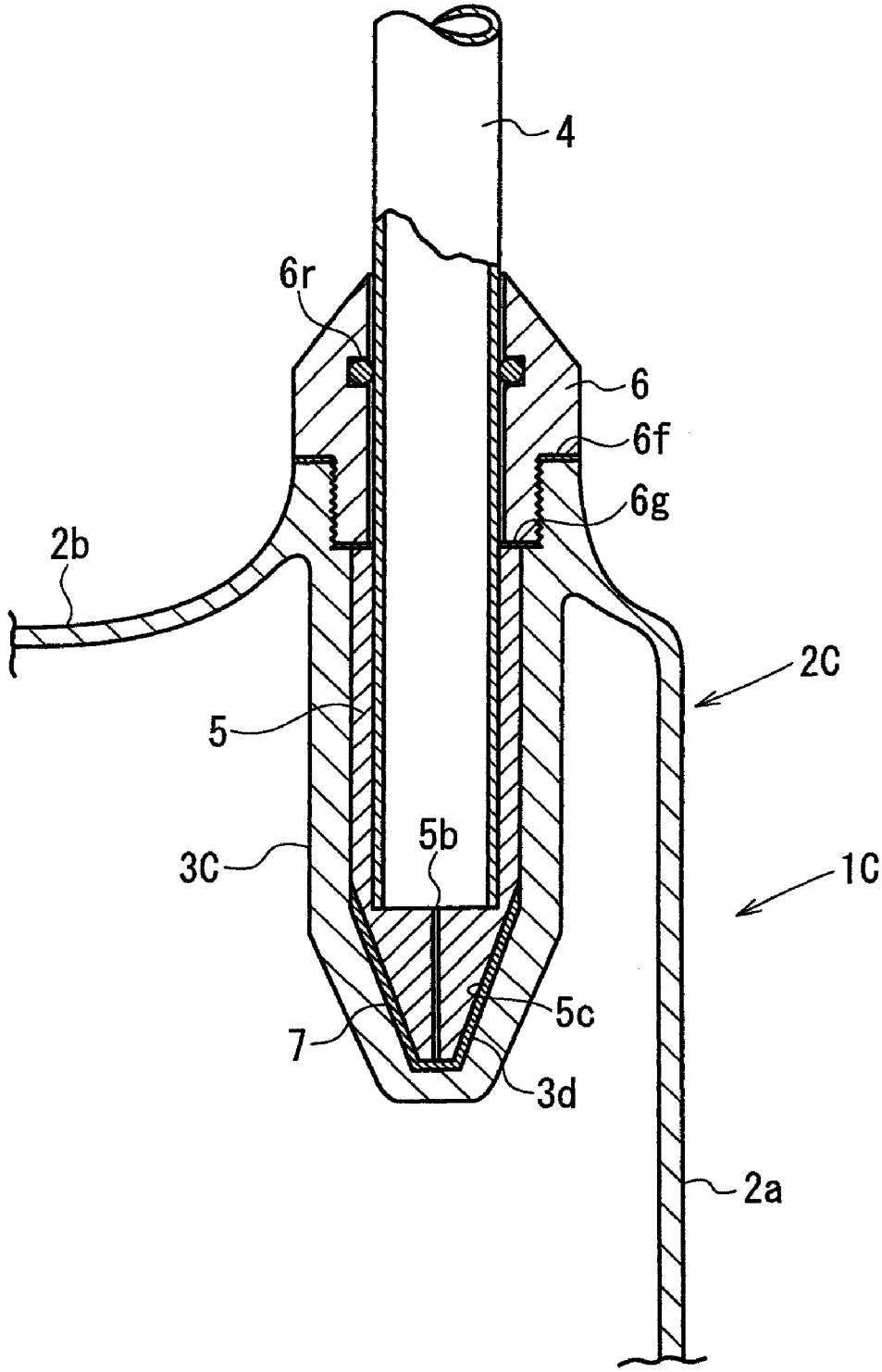
FIG. 19 is a section view of a head according to a sixth embodiment of the invention.

According to the invention, like a head 1C shown in FIG. 19, a head main body 2C and a hosel 3C may be formed as an integral body. The remaining structures of FIG. 19 are the same as FIG. 3, and the same designations thereof show the same composing elements of FIG. 3. In FIG. 19, there is used an O ring 6*r*; however, like FIG. 18, there may also be used the sleeve 6*s*. Here, in the inner peripheral surface of the sleeve 6*s*, there may also be formed an uneven portion like a female screw. In this case, a friction force between the sleeve inner peripheral surface and shaft can be reduced, thereby being able to facilitate the operation to mount and remove the sleeve with respect to the shaft. The female screw portion may be made of metal, and the other portion may be formed of an elastomer or resin.

Figure 20:
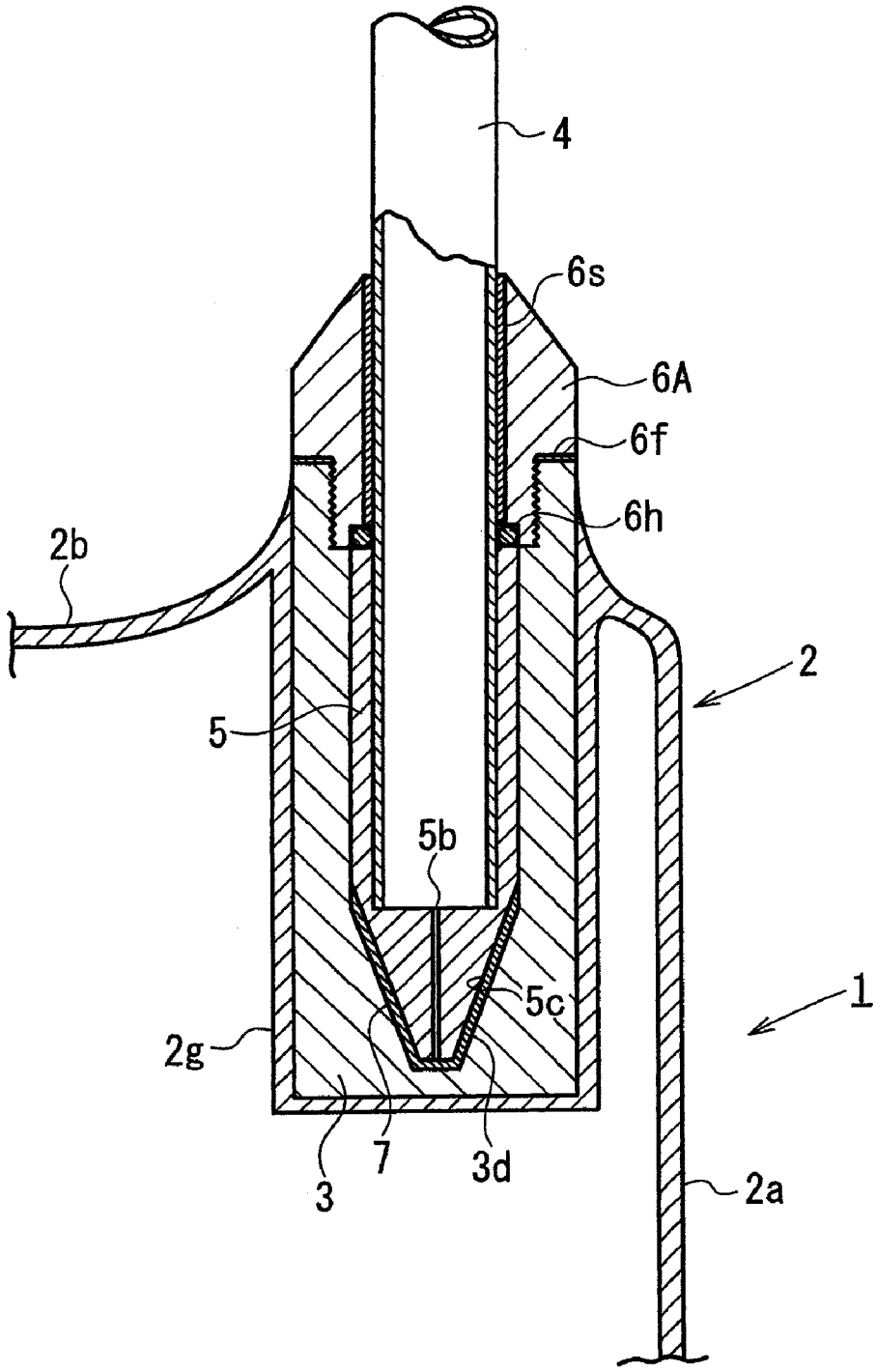
FIG. 20 is a section view of a head according to a seventh embodiment of the invention.

According to the invention, there may be omitted a spacer 6*g* which is interposed between the screw member and hosel 3 and, instead of it, an O ring may be wound around the shaft 4. FIG. 20 is a section view of a head according to such embodiment. In FIG. 20, in the periphery of the inner peripheral surface of the lower end of a screw member 6A, there is formed a recessed step portion, and an O ring 6*h* is provided on the recessed step portion. The inner peripheral surface of the O ring 6*h* is in contact with the shaft 4. When the screw member 6A is screwed into the hosel 3, the O ring 6*h* is held and pressed by and between the screw member 6A and hosel 3, whereby it is deformed as if it was crushed. The remaining structures of FIG. 20 are the same as FIG. 18, and the same designations thereof show the same composing elements of FIG. 18.

Figure 21:
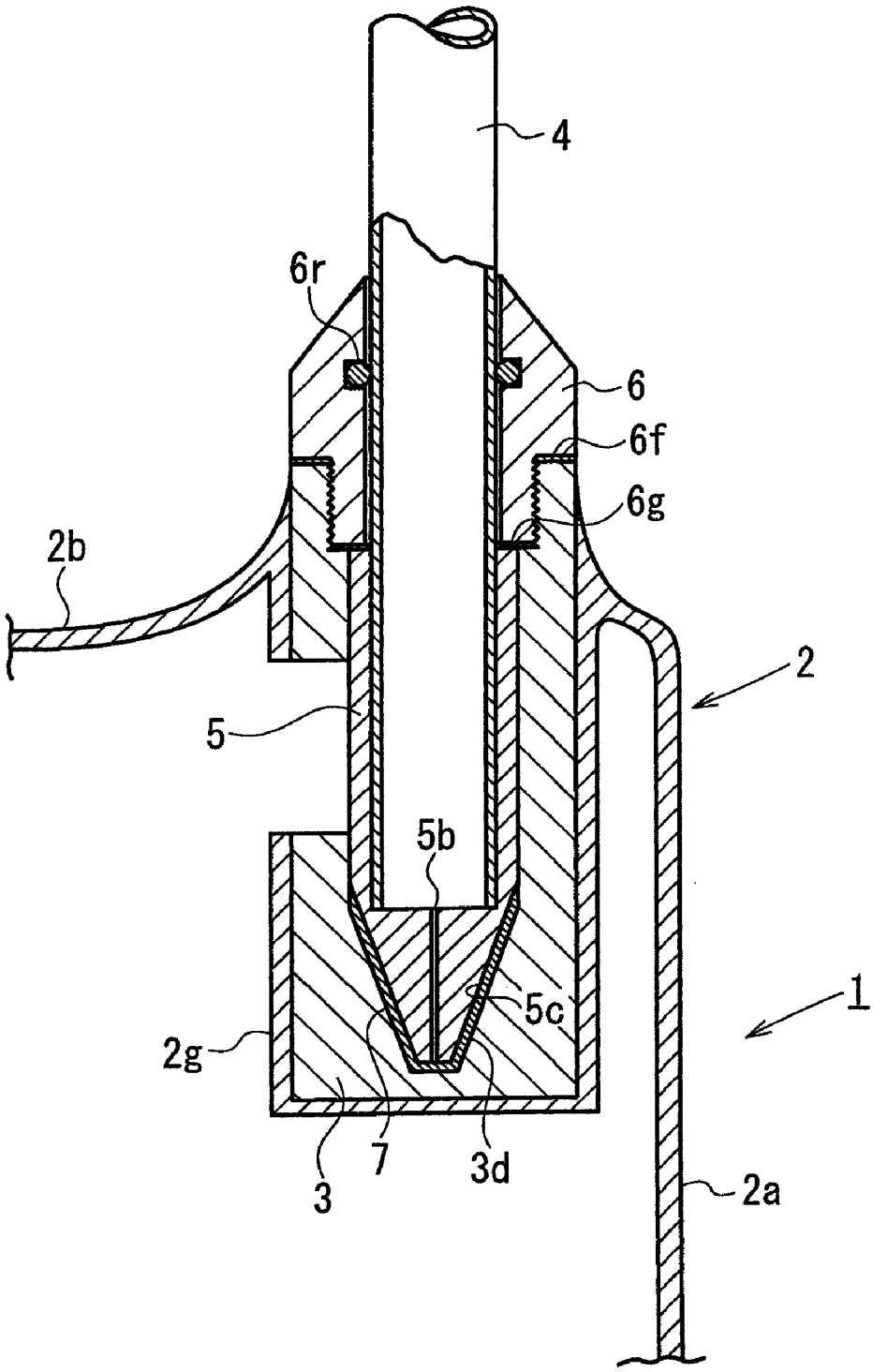
FIG. 21 is a section view of a hosel having an opening, a shaft case and a screw member.
Figure 22:
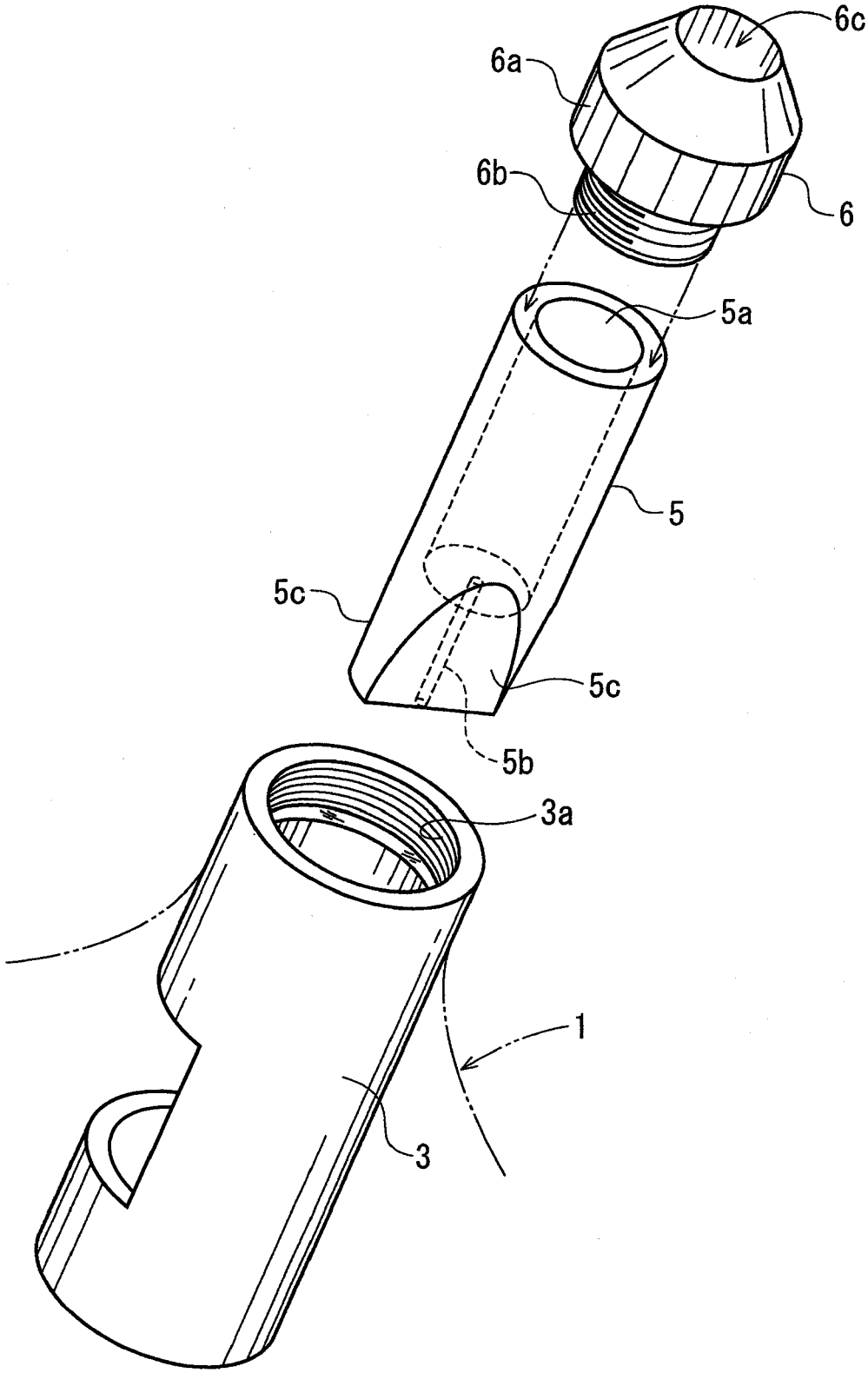
FIG. 22 is a perspective view of a hosel having an opening, a shaft case and a screw member.
Figure 23:
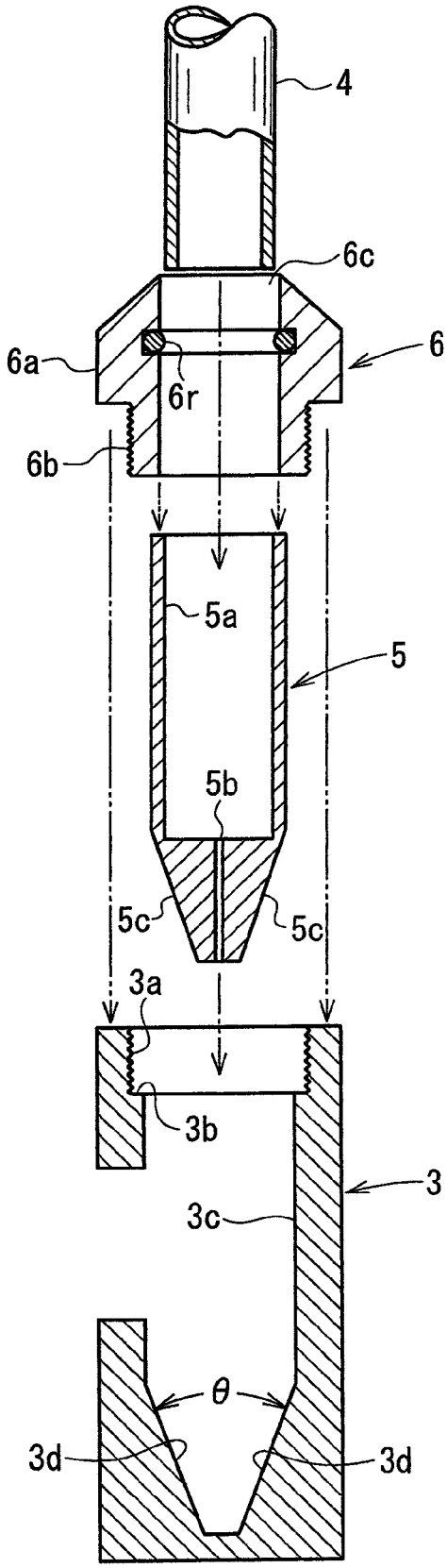
FIG. 23 is a section view of a hosel having an opening, a shaft case and a screw member.

The hosel may have an opening to expose the shaft case to an inner face of the golf club head when the shaft case is inserted into the hosel as shown in FIGS. 21 to 23. The opening has an effect on weight saving and balancing.

As describes with reference to the embodiment, there is provided a golf club in which a shaft with a shaft case provided separately from a head can be firmly fixed to the head and the shaft case can be easily mounted on and removed from the head, and a method for replacing the shaft of the golf club.

In a golf club and a shaft replacing method according to the embodiment, when the screw member is loosened and removed, the shaft case can be pulled out from the hosel. Specifically, a new shaft case/shaft connected assembly, in which a new shaft has been previously mounted on a shaft case, may be inserted into the hosel, and the screw member may be then threadedly mounted onto the assembly, whereby the old shaft can be replaced with the new shaft.

According to the embodiment, since the shaft case is inserted into the cylindrical-shaped hosel and is fixed to the hosel using the screw member, the mounting of the shaft case on the hosel can be made firm.

Conventionally, after the adhesive is heated to thereby destroy the structure thereof, a currently used shaft is removed and a new shaft is then mounted using the adhesive again. This takes troublesome labor and time. On the other hand, the invention can save such troublesome labor and time. Owing to this, just after the shaft is removed from the head of the golf club used for a ball hitting test, another shaft of different characteristics can be mounted onto the head of the golf club for another hitting test. This makes it possible for a golfer to find out a proper golf club in a golf shop very easily.

According to the embodiment, when the screw member is screwed into the upper end side of the hosel, the lower end of the screw member is contacted with the upper end face of the shaft case, so that the shaft case can be fixed.

According to the embodiment, the shaft can be inserted into the deep portion of the shaft case, which makes it possible to adhere the shaft to the shaft case firmly.

According to the embodiment, the peripheral direction positioning of the shaft case can be carried out. Also, the head and shaft case can be prevented against rotation with respect to each other. Here, preferably, there may be formed non-circular section portions in the shaft case and hosel respectively. In this case, when the grip includes a projecting portion, the projecting portion can be positioned accurately in the surface that, when a golfer holds the golf club for addressing a golf ball, faces the ground.

According to the embodiment, the shaft case can be easily inserted into the hosel.

According to the embodiment, shocks and vibrations generated between the shaft case and the inner surface of the hosel can be absorbed.

According to the embodiment, possible generation of rickety motion between the screw member and shaft can be prevented.

What is claimed is:

1. A golf club comprising:

a golf club head having a hosel;

a shaft;

a shaft case fixed to one end of the shaft, and inserted into the hosel, the shaft case being formed in a substantially cylindrical shape; and a ring-shaped screw member screwed into one end of the hosel to fix the shaft case in the hosel, the ring-shaped screw member being detachable from the hosel, wherein the hosel comprises a non-circular shaped portion comprising a pair of inclined surfaces, the inclined surfaces are arranged symmetrically with a center axis of the hosel between them wherein an elastic member is interposed between the other end of the shaft case and the other end of the hosel and along the pair of inclined surfaces.

2. The golf club according to claim 1, wherein the head includes a head main body and the hosel fixed to the head main body, wherein one end of the hosel includes a female screw on an inner face thereof, the female screw being formed by graving, and wherein the ring-shaped screw member includes a male screw on an outer face thereof, the male screw being screwed on the female screw to fix the ring-shaped screw member to the hosel, wherein the shaft case is fixed to the hosel by the ring-shaped screw member in a state that the ring-shaped screw member contacts with one end of the shaft case.

3. The golf club according to claim 2, wherein the shaft case is made of a cylindrical member having an open end on one end of the shaft case and a close end on the other end of the shaft case, wherein the shaft is inserted into the shaft case and is fixed to the shaft case by using an adhesive.

4. The golf club according to claim 3, wherein at least the other end of the shaft case includes a non-circular shaped portion, and wherein the non-circular shaped portion of the hosel corresponds to the other end of the shaft case.

5. The golf club according to claim 4, wherein the non-circular shaped portion of the shaft case includes an inclined surface that is inclined obliquely with respect to a center axis of the shaft case, and wherein the inclined surfaces of the hosel are inclined obliquely with respect to the center axis of the hosel.

6. The golf club according to claim 3, the hosel has an opening to expose the shaft case to an inner face of the golf club head when the shaft case is inserted into the hosel.

7. The golf club according to claim 1, further comprising an elastic member interposed between the ring-shaped screw member and the shaft.

8. The golf club according to claim 1, further comprising a grip mounted on the other end of the shaft, the grip including a projecting portion extending in the longitudinal direction of the shaft.

9. The golf club according to claim 1, wherein the hosel is integrally formed with the golf club head.

10. The golf club according to claim 1, wherein an angle between the inclined surfaces ranges from 10 to 30 degrees.

11. The golf club according to claim 1, wherein the inclined surfaces form a V-shaped configuration.

* * * * *